US010073484B2

(12) United States Patent
Liu

(10) Patent No.: US 10,073,484 B2
(45) **Date of Patent: *Sep. 11, 2018**

(54) POWER ON RESET (POR) CIRCUIT WITH CURRENT OFFSET TO GENERATE RESET SIGNAL

(71) Applicant: STMicroelectronics (Shenzhen) R&D Co. Ltd, Shenzhen (CN)

(72) Inventor: Yong Feng Liu, Shenzhen (CN)

(73) Assignee: STMicroelectronics (Shenzhen) R&D Co., Ltd, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/671,657

(22) Filed: Aug. 8, 2017

(65) Prior Publication Data

US 2017/0336822 A1 Nov. 23, 2017

Related U.S. Application Data

(63) Continuation of application No. 14/887,739, filed on Oct. 20, 2015, now Pat. No. 9,760,108.

(30) Foreign Application Priority Data

Oct. 20, 2015 (CN) ..... 2015 1 0654841

(51) Int. Cl.
*G05F 3/26* (2006.01)

(52) U.S. Cl.
CPC ..... *G05F 3/267* (2013.01)

(58) Field of Classification Search
CPC ..... G05F 3/20; G05F 3/26; G05F 3/267
See application file for complete search history.

(56) References Cited

U.S. PATENT DOCUMENTS 5,367,249 A * 11/1994 Honnigford ..... G05F 3/20 323/313
5,453,679 A * 9/1995 Rapp ..... G05F 3/30 323/313
5,523,709 A * 6/1996 Phillips ..... H03K 17/22 327/143
5,629,611 A * 5/1997 McIntyre ..... G05F 3/267 323/313
6,392,470 B1 * 5/2002 Burstein ..... G05F 3/30 327/539
6,509,726 B1 * 1/2003 Roh ..... G05F 3/30 323/313
6,885,224 B2 * 4/2005 Hastings ..... H03K 5/08 327/53

(Continued)

*Primary Examiner* — Yusef A Ahmed
(74) *Attorney, Agent, or Firm* — Crowe & Dunlevy

(57) ABSTRACT

A Schmitt trigger circuit having an input coupled to a current summing junction. A trickle current source generates a trickle current applied to the current summing junction. A bandgap current source generates a bandgap current applied to the current summing junction (wherein the bandgap current is fixed when a supply voltage exceeds a threshold). A variable current source generates a variable current applied to the current summing junction (wherein the variable current varies dependent on the supply voltage). At the current summing junction, the variable current is offset against the trickle and bandgap currents with respect to generating a voltage that is sensed at the Schmitt trigger circuit input.

22 Claims, 4 Drawing Sheets

(56) References Cited

U.S. PATENT DOCUMENTS 7,977,931 B2 * 7/2011 Wadhwa ..... G05F 1/565 323/314
2005/0275434 A1 * 12/2005 Acharya ..... G01R 31/31932 327/77
2006/0197584 A1 * 9/2006 Hsu ..... G05F 3/30 327/539
2008/0106308 A1 * 5/2008 Tu ..... G06F 1/24 327/143
2008/0122548 A1 * 5/2008 Jeong ..... H03K 3/0315 331/175
2009/0219066 A1 * 9/2009 Shkidt ..... H03K 17/22 327/143
2010/0259304 A1 * 10/2010 Huang ..... G06F 1/24 327/143
2011/0050285 A1 * 3/2011 Su ..... G01R 19/04 327/58
2011/0074470 A1 * 3/2011 Sanborn ..... H03K 17/223 327/143
2012/0229182 A1 * 9/2012 Lin ..... H03K 17/223 327/143
2013/0076410 A1 * 3/2013 Chen ..... G06F 1/24 327/143
2013/0106391 A1 * 5/2013 Tran ..... G05F 3/30 323/313
2013/0207696 A1 * 8/2013 Gonzalez ..... H03K 17/223 327/143
2015/0185747 A1 * 7/2015 Liu ..... G05F 1/565 323/268
2015/0185754 A1 * 7/2015 Liu ..... G05F 3/267 323/313
2016/0028355 A1 * 1/2016 Herrera ..... H03F 1/307 330/257
2016/0036417 A1 * 2/2016 Chen ..... H04L 25/0272 327/509
2016/0246317 A1 * 8/2016 Song ..... G05F 1/575

* cited by examiner

POWER ON RESET (POR) CIRCUIT WITH CURRENT OFFSET TO GENERATE RESET SIGNAL

CROSS REFERENCE TO RELATED APPLICATIONS

This application is a continuation of United States Application for patent Ser. No. 14/887,739 filed Oct. 20, 2015, which claims priority from Chinese Application for Patent No. 201510654841.9 filed Oct. 10, 2015, the disclosure of which is incorporated by reference.

TECHNICAL FIELD

The present invention relates to power on reset circuits and, in particular, to a power on reset circuit with a highly accurate threshold.

BACKGROUND

Power on reset (POR) circuits are well known in the art. These circuits operate in response to a rising supply voltage to control the logic state of a digital output signal to switch state values only after the rising supply voltage exceeds a threshold.

Reference is now made to FIG. 1 showing a circuit diagram for a conventional power on reset circuit 10. The circuit 10 receives power from a positive supply node 12 and a ground supply node 14. The circuit 10 includes a first circuit leg 16 comprising a series connection of a diode-connected p-channel MOSFET 18 and a resistive divider 20 formed by resistor R1 and resistor R2. The resistive divider 20 is connected between the drain terminal of transistor 18 and the ground supply node 14. The circuit 10 includes a second circuit leg 22 comprising a series connection of a p-channel MOSFET 24 and an n-channel MOSFET 26. The source terminals of transistors 18 and 24 are connected to the positive supply node 12. The gate terminals of transistors 18 and 24 are connected together. The transistors 18 and 24 accordingly form a current mirror circuit. The drain terminals of transistors 24 and 26 are connected together at node 28. A center tap node 30 of the resistive divider 20 is connected to the gate terminal of transistor 26. The source terminal of transistor 26 is connected to the ground supply node 14.

The circuit 10 further includes a Schmitt trigger circuit 34 having an input connected to node 28. The circuit also includes a logic NOT gate (inverter) 36 having an input connected to the output 38 of the Schmitt trigger circuit 34. The power on reset (POR) signal is generated at the output of the NOT gate 36.

The circuit 10 operates as follows: as the Vana voltage at the positive supply node 12 begins to rise, the transistors 18 and 24 are turned on. The voltage of the POR output signal is at ground. The voltage at node 28 rises with the rising Vana voltage and eventually crosses the high trigger threshold of the Schmitt trigger 34 causing the output of the Schmitt trigger to switch to the Vana voltage. The NOT gate 36 inverts the logic high output of the Schmitt trigger 34 and drives the POR output signal to ground. As the Vana voltage continues to rise, the current flowing through the diode connected transistor 18 also flows through the resistive divider 20. A divided voltage is developed by the resistive divider 20 at the tap node 30 and applied to the gate of transistor 26. With increasing Vana voltage, the divided voltage at the tap node 30 eventually exceeds the threshold voltage of the transistor 26 and transistor 26 begins to turn on. This causes the voltage at node 28 to fall. The voltage at node 28 eventually falls below the low trigger threshold of the Schmitt trigger 34. At this point, the output of the Schmitt trigger transitions to ground. The NOT gate 36 inverts the logic low output of the Schmitt trigger 34 and drives the POR output signal to the Vana voltage. Operational waveforms for the circuit 10 are shown in FIG. 2.

The circuit 10 has a known disadvantage in that its operational threshold relates to the thresholds of the n-channel and p-channel MOSFET devices used in the circuit. Thus, the operational threshold exhibits a corresponding wide spread with process corner and temperature. There is accordingly a need in the art for a POR circuit having a consistent Vana voltage at which the POR output signal is asserted.

SUMMARY

In an embodiment, a circuit comprises: a current summing junction; a bandgap current source circuit configured to generate a bandgap current applied to the current summing junction, wherein a magnitude the bandgap current is constant for a supply voltage which exceeds a first voltage threshold; and a variable current source circuit configured to generate a variable current applied to the current summing junction, wherein a magnitude of the variable current varies dependent on change in the supply voltage; wherein the variable current is offset against the bandgap current at the current summing junction.

In an embodiment, a method comprises: generating a bandgap current, wherein a magnitude of the bandgap current is constant for a supply voltage which exceeds a first voltage threshold; generating a variable current, wherein a magnitude of the variable current varies dependent on change in the supply voltage; and offsetting the variable current against the bandgap current at a current summing junction to generate an output signal.

In an embodiment, a circuit comprises: a current summing junction; a variable current source having a first bipolar transistor with a base terminal configured to receive a variable voltage dependent on a supply voltage and a current mirroring circuit operating responsive to current flowing in the first bipolar transistor to generate a variable current that is sunk from the current summing junction; and a bandgap current source having a second bipolar transistor with a base terminal configured to generate a bandgap voltage and a current mirroring circuit operating responsive to current flowing in the second bipolar transistor to generate a fixed bandgap current sourced to said current summing junction; wherein the first and second bipolar transistors are matching transistors.

BRIEF DESCRIPTION OF THE DRAWINGS

For a better understanding of the embodiments, reference will now be made by way of example only to the accompanying figures in which.

DETAILED DESCRIPTION OF THE DRAWINGS

Figure 1:
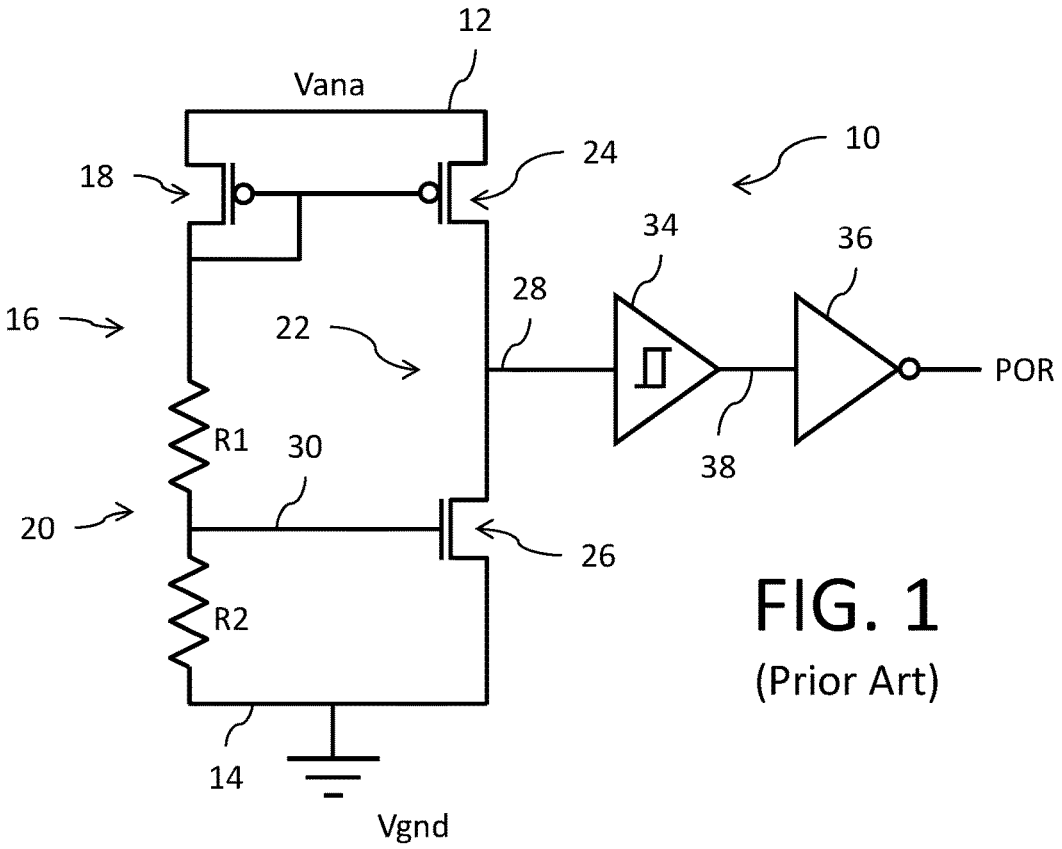
FIG. 1 (Prior Art)
FIG. 1 is a circuit diagram for a conventional power on reset circuit.
Figure 2:
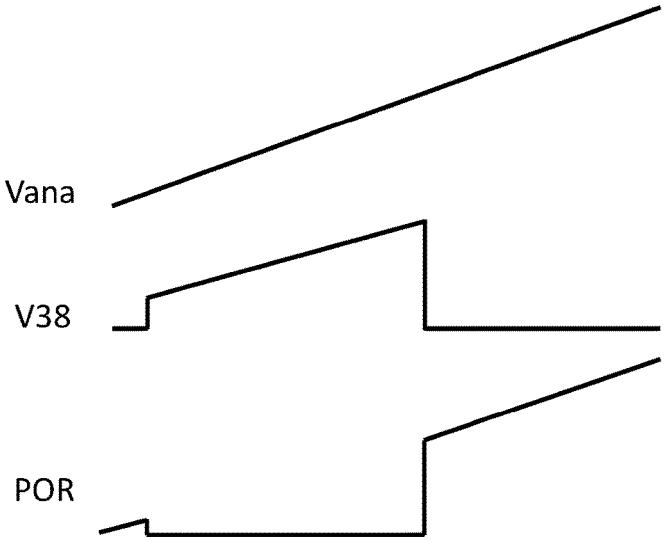
FIG. 2 (Prior Art)
FIG. 2 shows operational waveforms for the circuit of FIG. 1.
Figure 3:
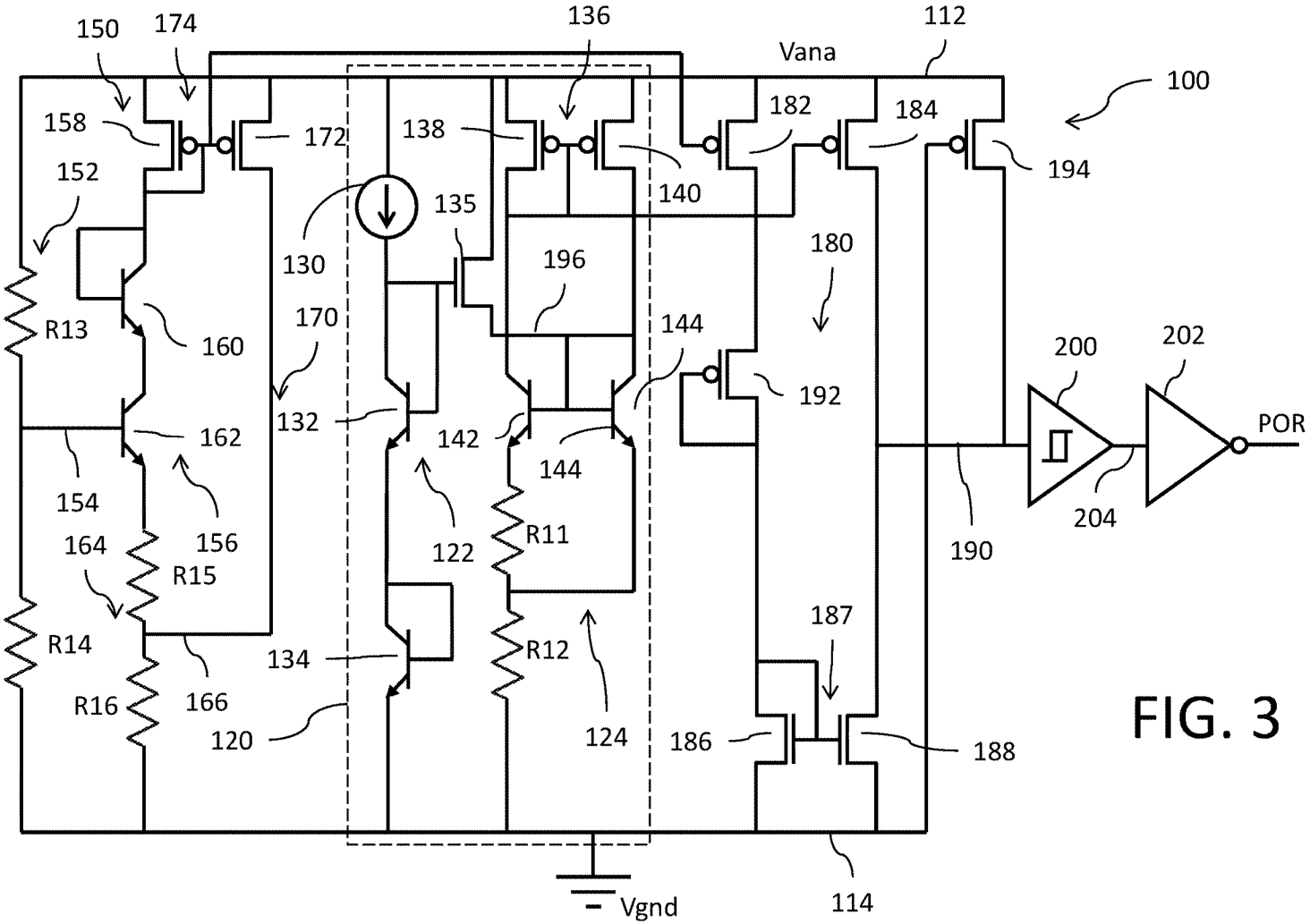
FIG. 3 is a circuit diagram for a power on reset circuit.

Reference is now made to FIG. 3 showing a circuit diagram for a power on reset circuit 100. The circuit 100 receives power from a positive supply node 112 and a ground supply node 114. The circuit 100 includes a fixed current generator circuit 120. The fixed current generator circuit 120 includes a start-up circuit 122 and a bandgap circuit block 124.

The start-up circuit 122 comprises a current source 130 connected in series with a pair of diode-connected NPN bipolar transistors 132 and 134 between nodes 112 and 114. The start-up circuit further includes a transistor 135 having a control (gate) terminal connected to the output of the current source and a current conduction path (source-drain path) coupled between the supply node 112 and node 196. The start-up circuit 122 responds to the Vana voltage to develop a control signal at the connected base and collector terminals of the diode-connected transistor 132 to control application of a bias voltage through transistor 135. This bias voltage is applied to the bandgap circuit block 124 at node 196 to ensure that the bandgap circuit block 124 starts and operates in a desired operational mode.

The bandgap circuit block 124 comprises a pair of NPN bipolar transistors 142 and 144 with their base terminals connected together (and further connected to the output of the start-up circuit 122 at node 196). The transistors 142 and 144 are operated at different current densities; this being achieved, for example, by using different emitter terminal areas for the two transistors 142, 144, but with equal currents. The equal currents through the two transistors 142, 144 is achieved using a current mirror circuit 136 (a load circuit) formed by two p-channel MOSFETs 138 and 140 with their gate terminals connected to each other and with the drain terminal of transistor 138 connected to the gate terminal of transistor 138 in a diode-connected configuration. The input of the current mirror circuit 136 is at the drain terminal of transistor 138 and at least one output of the current mirror circuit 136 is at the drain terminal of transistor 140. The source-drain path of transistor 138 is connected to the collector of transistor 142, and the source-drain path of transistor 140 is connected to the collector of transistor 144. A resistor R11 is connected between the emitter terminals of transistors 142 and 144. A resistor R12 is connected between the emitter of transistor 144 and the ground supply node 114.

In operation, a voltage is produced across the resistor R11 which is equal to the difference in the base-to-emitter voltages of transistors 142 and 144 ($\Delta V_{BE}$). The current through resistor R11 is therefore proportional to $\Delta V_{BE}$. Because the current through resistor R11 is proportional to, and perhaps equal to, the emitter current of 144, the current through resistor R12 is also proportional to $\Delta V_{BE}$, as will be the voltage appearing across resistor R12. The voltage at the base of transistors 142 and 144 will accordingly have a positive-temperature-coefficient component and a negative-temperature-coefficient component. For example, the voltage across resistor R12 has a positive temperature coefficient, and the $V_{BE}$ of transistor 144 has a negative temperature coefficient. Similarly, the voltage across both resistors R12 and R11 ($V_{R12+R11}$) has a positive temperature coefficient, and the $V_{BE}$ of transistor 142 has a negative temperature coefficient. With sufficient voltage supplied at the positive supply node 112, a band gap voltage $V_{BG}$ is generated at node 196 and this fixes a current flowing through the transistor 138. This fixed current is replicated through a current mirroring operation for output.

The circuit 100 further comprises a variable current generator circuit 150. The variable current generator circuit 150 includes a resistive divider 152 connected between the positive supply node 112 and the ground supply node 114. The resistive divider 152 includes series connected resistors R13 and R14. A tap node 154 is provided where resistors R13 and R14 make the series connection. The variable current generator circuit 150 further includes a first circuit leg 156 comprising a series connection of a diode-connected p-channel MOSFET 158, a diode-connected NPN bipolar transistor 160, an NPN bipolar transistor 162 and a resistive divider 164 formed by resistor R15 and resistor R16. The base terminal of transistor 162 is connected to tap node 154. The resistive divider 164 is connected between the emitter terminal of transistor 162 and the ground supply node 14. The resistive divider 164 includes a tap node 166 provided where resistors R15 and R16 make the series connection. The variable current generator circuit 150 includes a second circuit leg 170 comprising a p-channel MOSFET 172. The drain terminal of transistor 172 is connected to the tap node 166. The source terminals of transistors 158 and 172 are connected to the positive supply node 112. The gate terminals of transistors 158 and 172 are connected together, with the gate terminal of transistor 158 connected to the drain terminal of transistor 156. The transistors 158 and 172 accordingly form a current mirror circuit 174. The input of the current mirror circuit 174 is at the drain terminal of transistor 158 and at least one output of the current mirror circuit 174 is at the drain terminal of transistor 172.

The circuit 100 further comprises a current comparator circuit 180. The comparator circuit 180 includes a first input p-channel MOSFET 182 having its gate terminal connected to the gate terminals of transistors 158 and 172 of the current mirror circuit 174. Thus, a further output of the current mirror circuit 174 is present at the drain terminal of transistor 182. The current sourced by transistor 182 is a scaled replica of the current flowing through transistor 158 of the variable current generator circuit 150. The current comparator circuit 180 further includes a second input p-channel MOSFET 184 having its gate terminal connected to the gate terminals of transistors 138 and 140 of the current mirror circuit 136. Thus, a further output of the current mirror circuit 136 is present at the drain terminal of transistor 184. The current sourced by transistor 184 is a scaled replica of the current flowing through transistor 138 of the bandgap circuit block 124. The current from transistor 182 is mirrored by current mirror circuit 187 (formed by n-channel MOSFETs 186 and 188) and applied as a sinking current with the current sourced by transistor 184 at comparison node 190. A diode-connected p-channel MOSFET 192 is connected in series between the transistor 182 and the transistor 186 of the current mirror circuit 187.

The circuit 100 still further comprises a current source p-channel MOSFET 194 having a source-drain path connected between the positive supply node 112 and the comparison node 190. A gate terminal of transistor 194 is connected to the ground supply node 114.

In a preferred embodiment, the transistor 158 matches the transistor 138, the transistor 172 matches the transistor 140 and the transistor 162 matches the transistor 142. Also, the resistances of resistors R11 and R15 are the same, and the resistances of resistors R16 and R12 are the same. The ratio of transistor 186 and 188 is preferably 1:1. The transistor 182 matches the transistor 184.

The circuit 100 further includes a Schmitt trigger circuit 200 having an input connected to node 190. The circuit also includes a logic NOT gate (inverter) 202 having an input connected to the output 204 of the Schmitt trigger circuit 200. The power on reset (POR) signal is generated at the output of the NOT gate 202.

The circuit 100 operates as follows: the gate connection of transistor 194 to the ground supply node 114 ensures that transistor 194 is always turned on to source current to the comparison node 190. The transistor 194 is preferably a relatively small device that is configured to source a small current. As the voltage Vana begins to rise, the voltage at the comparison node 190 follows. When the rising voltage Vana is less than the threshold voltage of transistor 194, the voltage at the comparison node 190 is determined by the leakage currents of transistors 194 and 184 (for sourcing current) and transistors 188, 192 and 160 (for sinking current). The transistor 192 functions to suppress the leakage current of transistor 186. When the voltage Vana rises above the threshold voltage of transistor 194, but is less than the voltage needed to make the bandgap circuit block 124 operate at a normal state, the transistor 194 is turned on and sources current to the comparison node 190 (where the voltage follows the rising Vana voltage).

When the voltage at node 190 rises to exceed the high trigger threshold of the Schmitt trigger 200, the output 204 voltage of the Schmitt trigger switches from ground and also follows the Vana voltage. The NOT gate 202 inverts the higher voltage output of the Schmitt trigger 200 and drives the POR output signal to ground.

The Vana voltage continues to rise. The start-up circuit 122 generates a start-up bias voltage at node 196 that will ensure that the bandgap circuit block 124 starts in the proper operational mode to generate a bandgap voltage $V_{BG}$ output. When the Vana voltage rises to a level sufficient to generate the bandgap voltage $V_{BG}$ at node 196 (i.e., exceeds the bandgap operating threshold voltage), the voltage at the drain of transistor 138 is fixed in relation to the bandgap voltage $V_{BG}$, and this voltage biases the operation of transistor 184 to source a fixed current to the comparison node 190. The combined currents sourced by transistors 184 and 194 to the comparison node 190 exceed the current sunk by transistor 188, and so the voltage at the comparison node 190 continues to rise with Vana.

The resistive divider circuit 152 divides the Vana voltage for application to the base terminal of transistor 162. A current flows through transistors 158 and 162 in response to the divided voltage at tap node 154. As the Vana voltage increases, the current in transistors 158 and 162 correspondingly increases. This variable current is mirrored through transistor 182 and current mirror 187 for application as sinking current to the comparison node 190. Before the point where the Vana voltage rises to a level sufficient for normal operation of the bandgap circuit block 124, the mirrored current is less than the combined current sourced by transistors 184 and 194, and thus the voltage at the comparison node 190 will continue to rise with Vana. When the Vana voltage reaches the level sufficient for normal operation of the bandgap circuit block 124, the bandgap voltage $V_{BG}$ is generated at node 196, and the voltage at node 154 equals that bandgap voltage $V_{BG}$. The variable current flowing through transistor 158 will likewise equal the fixed current flowing through transistor 138. These currents are mirrored and cancel each other at the comparison node 190. The small fixed current from transistor 194 continues to be applied to the comparison node, and thus the voltage at the comparison node 190 will continue to follow the rising Vana voltage. This circuit 100, however, has now reached the tipping point for POR operation.

Figure 4:
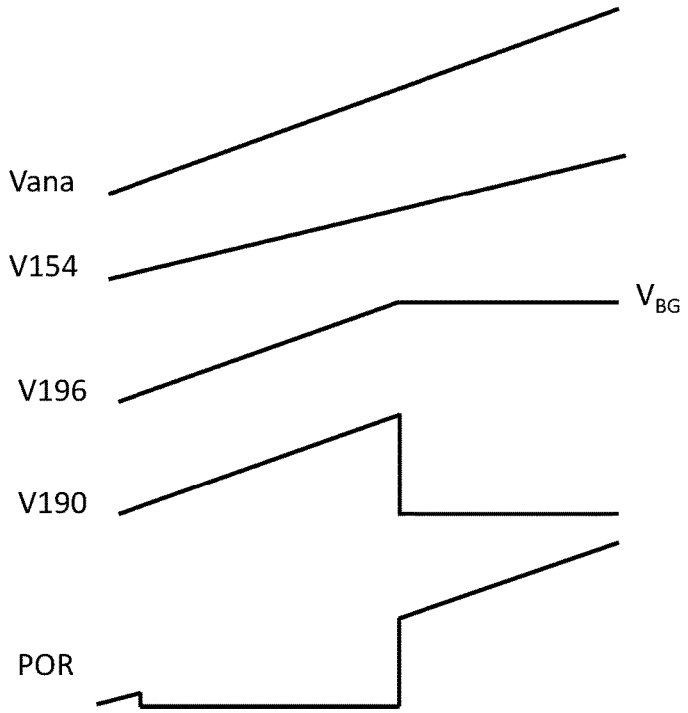
FIG. 4 shows operational waveforms for the circuit of FIG. 3.

As the Vana voltage continues to rise, the voltage at node 154 also rises causing an increase in the variable current flowing through transistor 158. When the current flowing through transistor 158 (as mirrored by transistor 182 and current mirror circuit 187) exceeds the sum of the currents sourced from transistors 184 and 194, the transistor 188 of the current mirror circuit 187 will pull the voltage at the comparison node 190 down. As the voltage at comparison node 190 falls below the low trigger threshold of the Schmitt trigger 34, the output of the Schmitt trigger transitions to ground. The NOT gate 36 inverts the logic low output of the Schmitt trigger 34 and drives the POR output signal to the Vana voltage. Operational waveforms for the circuit 100 are shown in FIG. 4. The POR reset voltage is accordingly dependent on the bandgap voltage $V_{BG}$ and the ratio of the resistors R13 and R14 in accordance with the following equation: $V_{POR}=((R13+R14)/R14)*V_{BG}$.

Figure 5:
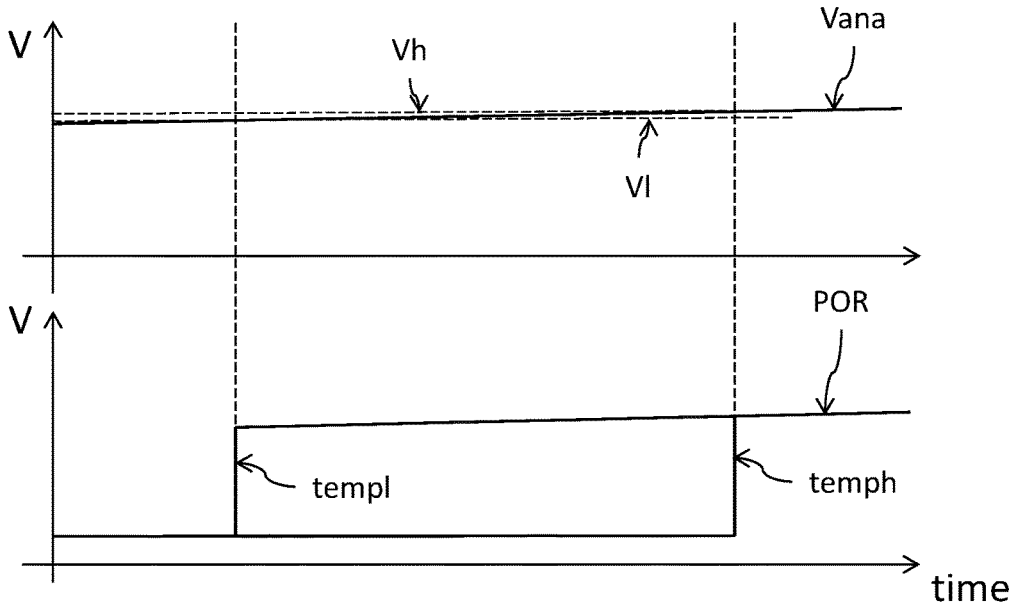
FIGS. 5-6 show simulated performance data for the circuit of FIG. 3.

FIG. 5 shows the region where the POR output signal changes state for high and low extremes of a temperature. The low transition voltage (Vl) level and the high transition voltage (Vh) level of the Vana voltage are very close to each other. In a simulation of the FIG. 3 circuit, Vl=2.57963 V at Vtempl=−40° C. and Vh=2.60007 V at Vtemph=150° C.

Figure 6:
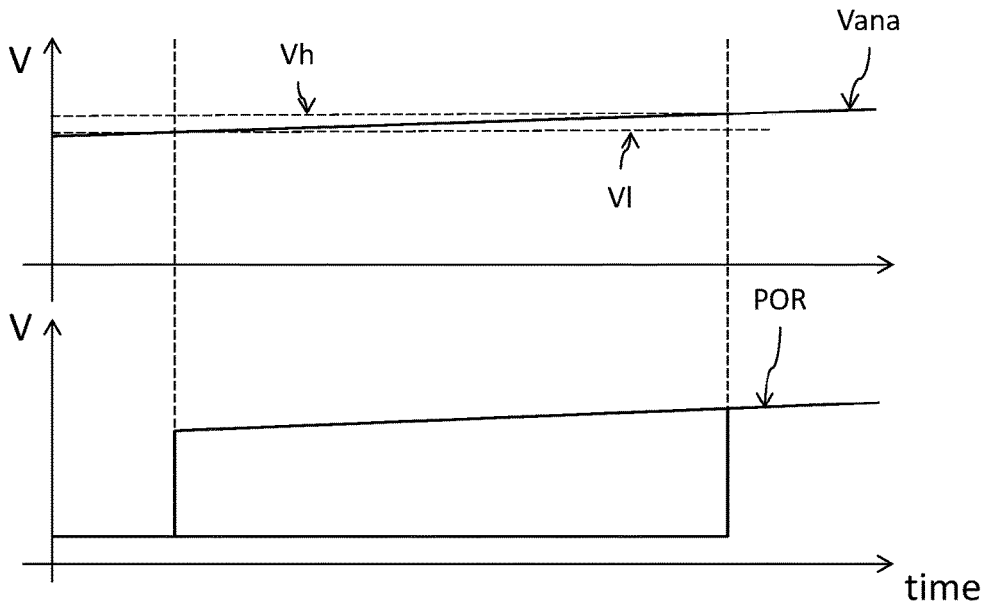

FIG. 6 shows the region where the POR output signal changes state across all process corner and temperature. The low transition voltage (Vl) level and the high transition voltage (Vh) level of the Vana voltage are very close to each other. In a simulation of the FIG. 3 circuit, Vl=2.55439 V and Vh=2.61952 V.

Figure 7:
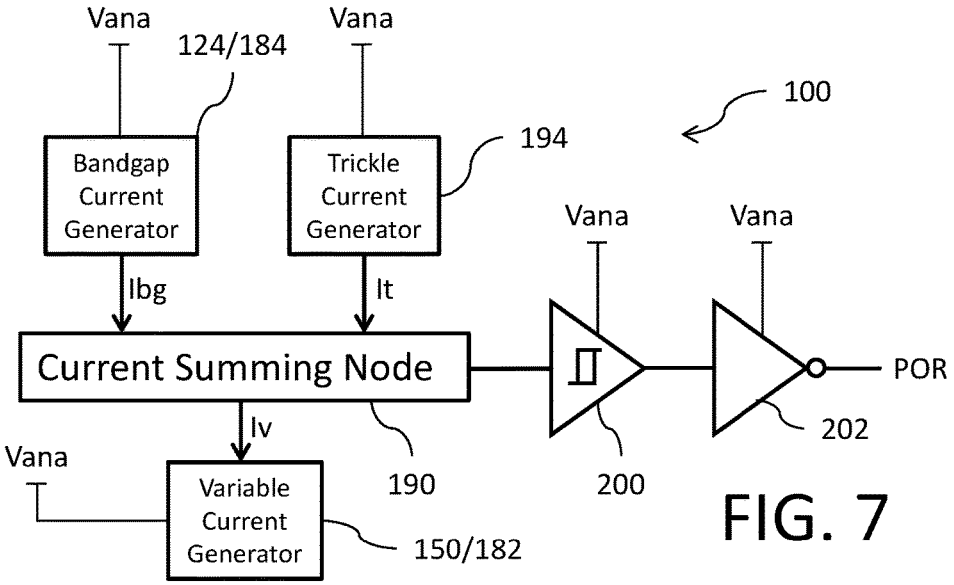
FIG. 7 is a block diagram of the circuit of FIG. 3.

Reference is now made to FIG. 7 showing a block diagram of the POR circuit 100 of FIG. 3. The comparison node 190 functions as a current summing junction with respect to a trickle current It generated by a trickle current generator (194), a bandgap current Ibg generated by a bandgap current generator (124) and a variable current Iv generated by a variable current generator (150). The voltage at the comparison node 190 follows the Vana voltage as it begins to rise due to the trickle current It sourced by the trickle current generator. The output of the Schmitt trigger circuit 200 then also follows the Vana voltage and the output of the NOT gate 202 drives the POR output signal to ground. The bandgap current generator likewise generates the bandgap current Ibg which rises with the increasing Vana voltage until the Vana voltage exceeds the normal operating voltage of the bandgap circuit. At that point, the bandgap current Ibg has a fixed magnitude dependent on the bandgap voltage. The variable current generator also generates the variable current Iv which rises with the increasing Vana voltage. When the Vana voltage reaches the normal operating voltage of the bandgap circuit, the variable current Iv substantially equals bandgap current Ibg. These currents cancel each other out at through the current summing operation performed at the comparison node 190. As the Vana voltage continues to increase, the variable current Iv correspondingly increases to exceed the fixed bandgap current Ibg and further exceed the sum of the fixed bandgap current Ibg and the trickle current It. At this point, the voltage at the comparison node 190 falls. The output of the Schmitt trigger circuit 200 then goes to ground and the output of the NOT gate 202 drives the POR output signal to follow the Vana voltage.

The foregoing description has been provided by way of exemplary and non-limiting examples of a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. A circuit, comprising:

a current summing junction;

a variable current source having a first bipolar transistor with a base terminal configured to receive a variable voltage dependent on a supply voltage and a current mirroring circuit operating responsive to current flowing in the first bipolar transistor to generate a variable current that is sunk from the current summing junction; and a bandgap current source having a second bipolar transistor with a base terminal configured to generate a bandgap voltage and a current mirroring circuit operating responsive to current flowing in the second bipolar transistor to generate a fixed bandgap current sourced to said current summing junction;

wherein the first and second bipolar transistors are matching transistors.

2. The circuit of claim 1, further comprising a trickle current source configured to generate a trickle current sourced to said current summing junction.

3. The circuit of claim 1, further comprising a circuit configured to compare a voltage at the current summing junction against a second voltage threshold greater than the first voltage threshold.

4. The circuit of claim 3, wherein the second voltage threshold exhibits hysteresis.

5. The circuit of claim 4, wherein the circuit configured to compare is a Schmitt trigger circuit.

6. A circuit, comprising:

a current summing junction;

a bandgap current source circuit configured to generate a bandgap current applied to the current summing junction, wherein a magnitude the bandgap current is constant for a supply voltage which exceeds a first voltage threshold;

a variable current source circuit configured to generate a variable current applied to the current summing junction, wherein a magnitude of the variable current varies dependent on change in the supply voltage; and a trickle current source circuit configured to generate a trickle current applied to the current summing junction, wherein the variable current is offset against a sum of the trickle and bandgap currents at the current summing junction.

7. The circuit of claim 6, further comprising a circuit configured to compare a voltage at the current summing junction against a second voltage threshold greater than the first voltage threshold.

8. The circuit of claim 7, wherein the second voltage threshold exhibits hysteresis.

9. The circuit of claim 8, wherein the circuit configured to compare is a Schmitt trigger circuit.

10. The circuit of claim 7, wherein the voltage at the current summing junction is indicative of whether the change in the supply voltage has exceeded a circuit reset voltage level.

11. The circuit of claim 10, further comprising a reset circuit configured to generate a reset signal in response to change in the supply voltage exceeding the circuit reset voltage level.

12. The circuit of claim 6, wherein the variable current source circuit comprises: a first bipolar transistor having a base terminal coupled to receive a voltage dependent on the supply voltage; and wherein the bandgap current source circuit comprises: a second bipolar transistor having a base terminal configured to generate a bandgap voltage;

wherein the first and second bipolar transistors are matching transistors.

13. The circuit of claim 12, wherein the variable current source circuit further comprises: a first resistive divider circuit coupled in series with the first bipolar transistor; and wherein the bandgap current source circuit further comprises: a second resistive divider circuit coupled in series with the second bipolar transistor;

wherein the first and second resistive divider circuits are matching circuits.

14. A method, comprising:

generating a bandgap current, wherein a magnitude of the bandgap current is constant for a supply voltage which exceeds a first voltage threshold;

generating a variable current, wherein a magnitude of the variable current varies dependent on change in the supply voltage;

generating a trickle current applied to a current summing junction; and offsetting the variable current against a sum of the trickle and bandgap currents at the current summing junction to generate an output signal.

15. The method of claim 14, further comprising comparing a voltage of the output signal against a second voltage threshold greater than the first voltage threshold.

16. The method of claim 15, wherein the second voltage threshold exhibits hysteresis.

17. The method of claim 15, wherein the voltage of the output signal is indicative of whether the change in the supply voltage has exceeded a circuit reset voltage level.

18. The method of claim 17, further comprising generating a reset signal in response to change in the supply voltage exceeding the circuit reset voltage level.

19. A circuit, comprising:

a current summing junction;

a variable current source having a first bipolar transistor with a base terminal configured to receive a variable voltage dependent on a supply voltage and a current mirroring circuit operating responsive to current flowing in the first bipolar transistor to generate a variable current that is sunk from the current summing junction;

a trickle current source configured to generate a trickle current sourced to said current summing junction; and a bandgap current source having a second bipolar transistor with a base terminal configured to generate a bandgap voltage and a current mirroring circuit operating responsive to current flowing in the second bipolar transistor to generate a fixed bandgap current sourced to said current summing junction;

wherein the first and second bipolar transistors are matching transistors.

20. The circuit of claim 19, further comprising a circuit configured to compare a voltage at the current summing junction against a second voltage threshold greater than the first voltage threshold.

21. The circuit of claim 20, wherein the second voltage threshold exhibits hysteresis.

22. The circuit of claim 21, wherein the circuit configured to compare is a Schmitt trigger circuit.

* * * * *